US005823895A

United States Patent [19]

Rasic

[11] Patent Number: 5,823,895

[45] Date of Patent: Oct. 20, 1998

[54] PORTABLE, COMPACT, AND DURABLE ATHLETIC TRAINING APPARATUS

[76] Inventor: Rale Rasic, Lot 15 Elizabeth Dr., Cecil Park 2171 NSW, Australia

[21] Appl. No.: 803,931

[22] Filed: Feb. 21, 1997

[51] Int. Cl.[6] ..... A63B 69/00; A63B 63/00

[52] U.S. Cl. ..... 473/430; 473/478

[58] Field of Search ..... 743/428, 429, 743/430; 273/104, 108, 109, 160, 212, 213, 398, 400, 401, 402

[56] References Cited

U.S. PATENT DOCUMENTS

| | | | |
|---|---|---|---|
| 4,258,923 | 3/1981 | Senoh | 273/398 |
| 4,295,648 | 10/1981 | Stromback | 273/402 X |
| 4,592,555 | 6/1986 | Bradford | 273/402 |
| 4,786,053 | 11/1988 | Barnes, Jr. | 473/416 |
| 4,881,742 | 11/1989 | Hargreave . | |
| 5,246,226 | 9/1993 | McGuinn . | |
| 5,282,615 | 2/1994 | Green et al. . | |
| 5,358,258 | 10/1994 | Killion . | |
| 5,398,940 | 3/1995 | Derst, III | 473/430 |
| 5,516,116 | 5/1996 | Castro | 473/429 |

*Primary Examiner*—William H. Grieb
*Attorney, Agent, or Firm*—Skjerven, Morrill, MacPherson, Franklin & Friel LLP; Ken J. Koestner

[57] ABSTRACT

An athletic training apparatus includes a support frame with a plurality of detachable frame segments. The support frame is supported by removable anchor pins affixing side members of the support frame to set the position of the side members on a surface and supported by taut lines connected to an upper portion of the side members and connected to anchors. The athletic training apparatus is easy to assemble and transport has a sturdy frame that connects quickly and securely. The apparatus includes a suspended ball, such as a regulation soccer ball, which is easily adjusted in height to support desired training techniques. In one embodiment, an apparatus includes a support frame having a plurality of detachable firm frame segments including a first side segment, a second side segment, and a top segment. The apparatus also includes a first anchor pin affixing the position of the first side segment on a surface and a second anchor pin affixing the position of the second side segment on the surface. The apparatus has a first line for connecting to the first side segment and for stretching tautly between two anchors so that the first side segment is vertically supported and a second line for connecting to the second side segment and for stretching tautly between two anchors so that the first side segment is vertically supported. A suspension line is supplied for connecting, suspending and supporting an athletic gamepiece from the top segment.

14 Claims, 5 Drawing Sheets

PORTABLE, COMPACT, AND DURABLE ATHLETIC TRAINING APPARATUS

BACKGROUND OF THE INVENTION

1. Field of the Invention

The present invention relates to an apparatus for sports training. Specifically, the present invention relates to an apparatus for practicing striking, blocking and tracking skills in sports played using a ball.

2. Description of the Related Art

Striking, heading, trapping, and blocking are skills that are important for proficiency in soccer playing. These skills are developed while playing a soccer game but may be improved more efficiently through the usage of training equipment. This efficiency is gained because a player using a training apparatus can repeatedly practice various motions, exercises and techniques much more frequently than is possible during the playing of a game.

Thus, an apparatus that allows a player to repeatedly perform training drills that realistically approximate actual game conditions is useful in improving the skills of the player. An apparatus is most useful that allows a player to practice under realistic conditions even when facilities and playing partners are unavailable.

One example of an athletic training apparatus is described in U.S. Pat. No. 4,881,742, entitled "Volleyball Technique Trainer", issued to F. M. Hargreave on Nov. 21, 1989. The Hargreave apparatus is used for assisting in the training of volleyball players and is comprised of a means of supporting the apparatus at a predetermined height above a surface; an arm member rotatably mounted to said support means for rotation around a substantially horizontal axis; a volleyball; and a semi-rigid tether which suspends the volleyball from the arm member. The apparatus allows the user to practice the skills of serving, passing, and spiking in a repeatable and efficient fashion such that the skills may be learned and become a cognitive response during an actual volleyball game.

One problem with conventional athletic training equipment is that suitably durable equipment is too heavy and bulky for easy transfer from location to location. Equipment that is large enough to be useful for training are typically somewhat larger than the players and therefore very difficult to transport in an automobile trunk or interior bed surface of a station wagon.

Another problem with conventional athletic training structures is that large forces are imposed on the structures during usage so that a firm horizontal support is necessary. This firm support is typically provided by a large bulky base structure or by planting the structure firmly into the earth, often using a concrete base to stabilize the structure. A bulky but portable structure is difficult to transport. A firmly planted structure is not conveniently portable.

What is needed is a convenient, compact, lightweight and portable athletic training apparatus that is safe, firm and durable.

SUMMARY OF THE INVENTION

In accordance with the present invention, an athletic training apparatus includes a support frame with a plurality of detachable frame segments. The support frame is supported by removable anchor pins affixing side members of the support frame to set the position of the side members on a surface and supported by taut lines connected to an upper portion of the side members and connected to anchors. The athletic training apparatus is easy to assemble and transport has a sturdy frame that connects quickly and securely.

The apparatus includes a suspended ball, such as a regulation soccer ball, which is easily adjusted in height to support desired training techniques.

In accordance with an embodiment of the present invention, an apparatus includes a support frame having a plurality of detachable firm frame segments including a first side segment, a second side segment, and a top segment. The apparatus also includes a first anchor pin affixing the position of the first side segment on a surface and a second anchor pin affixing the position of the second side segment on the surface. The apparatus has a first line for connecting to the first side segment and for stretching tautly between two anchors so that the first side segment is vertically supported and a second line for connecting to the second side segment and for stretching tautly between two anchors so that the first side segment is vertically supported. A suspension line is supplied for connecting, suspending and supporting an athletic gamepiece from the top segment.

In accordance with another embodiment of the present invention, an apparatus includes a support frame having a plurality of detachable firm frame segments including a first lower side segment, a first upper side segment, a second lower side segment, a second upper side segment, and a top segment. The apparatus also has an auxiliary top segment with two of the side segments selected from the lower first side segment, the upper first side segment, the lower second side segment, and the upper second side segment being connected to the top segment and the remaining two side segments being connected to the auxiliary top segment to form two goal structures. A vertical support structure is included for supporting the support frame and a suspension line is used for connecting, suspending and supporting an athletic game piece from the top segment.

Many advantages are gained by the described portable soccer technique training apparatus. It is advantageous that the apparatus allows a player to practice in realistic simulated playing conditions. The support frame of the apparatus advantageously is light in weight and highly durable and, therefore, highly suitable for a portable soccer technique training apparatus. The illustrative vertical support structure advantageously is completely portable and capable of set-up in virtually any suitably horizontal surface, no matter how compact. Furthermore, the portable soccer technique training apparatus is installed with virtually no impact on the environment such as formation of buried concrete support blocks that could injure players when the training apparatus is removed. Advantageously, a vertical support structure including anchor pins and stakes is very light in weight so that the vertical support structure is highly portable and positionable in virtually any location. Accordingly, the portable soccer technique training apparatus is suitable for usage at home, even in small yard areas, as well as fields, clubs, parks, schools and beaches. Furthermore, the vertical support structure is stable without support by any persons such as players or a coach so that an individual play advantageously may practice soccer skills alone. The portable soccer technique training apparatus advantageously is a simple, safe, portable and affordable athletic device

BRIEF DESCRIPTION OF THE DRAWINGS

The features of the described embodiments believed to be novel are specifically set forth in the appended claims. However, embodiments of the invention relating to both structure and method of operation, may best be understood by referring to the following description and accompanying drawings.

DETAILED DESCRIPTION OF THE ILLUSTRATIVE EMBODIMENTS

Figure 1:
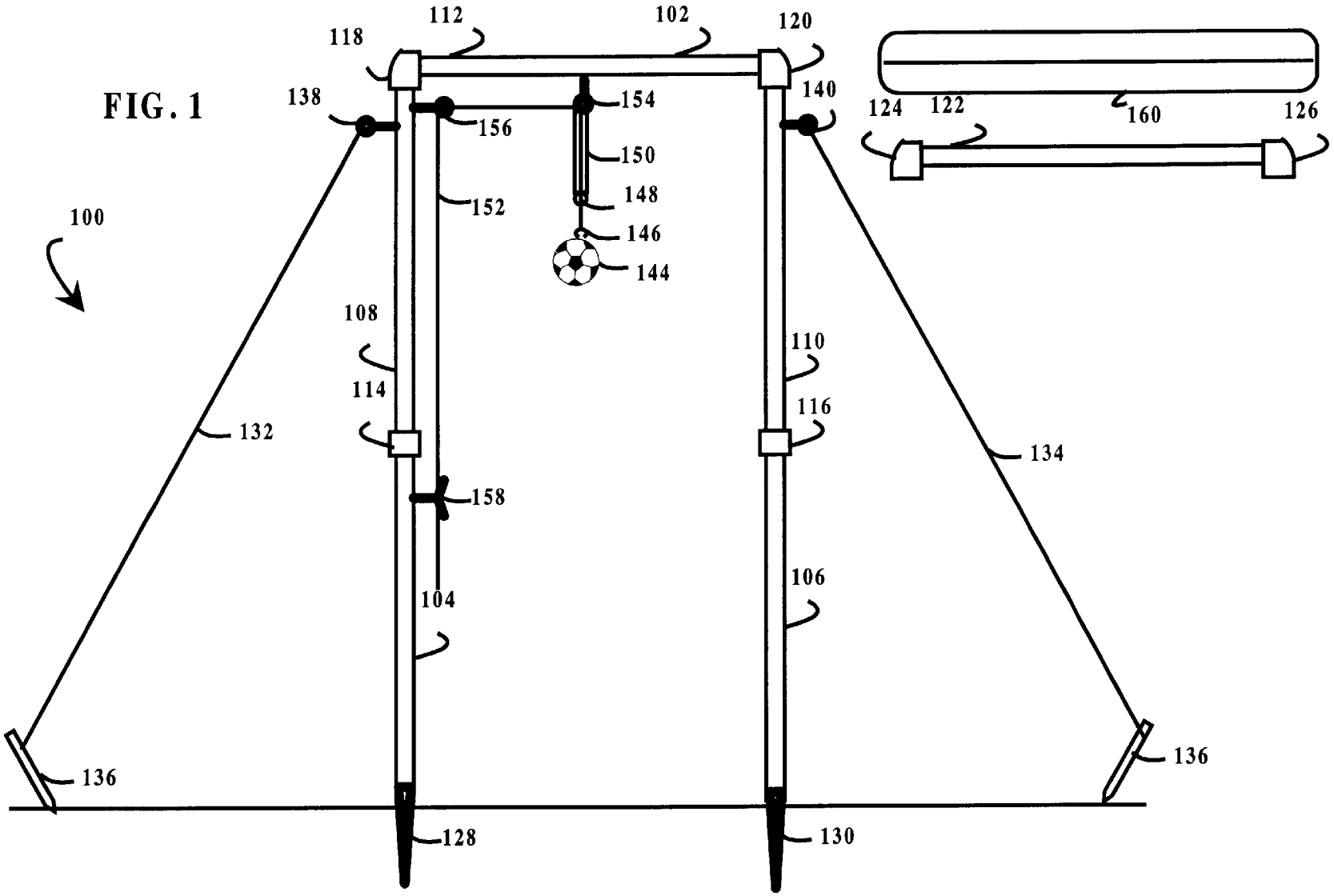
FIG. 1 is a schematic pictorial frontal view illustrating an embodiment of a portable soccer technique training apparatus.

Referring to FIG. 1, a schematic pictorial frontal view illustrates a portable soccer technique training apparatus 100 including a frame 102 made up of two lower side poles 104 and 106, two upper side poles 108 and 110, a top pole 112, two collars 114 and 116, and two 90° elbow joints 118 and 120. The lower side pole 104 is connected to the upper side pole 108 by the collar 114. The lower side pole 106 is connected to the upperside pole by the collar 116. The top pole 112 is connected to the upper side pole 108 by the 90° elbow joint 118 and connected to the upper side pole 110 by the 90° elbow joint 120. Connected in this manner, the frame 102 forms a shape of an inverted-U. In the illustrative embodiment, the portable soccer technique training apparatus 100 includes an auxiliary top pole 122 and two auxiliary 90° elbow joints 124 and 126.

The six poles including the two lower side pole s 104 and 106, the two upper side poles 108 and 110, the top pole 112, and the auxiliary top pole 122 are illustratively hollow cylindrical PVC pipe of a suitable length. In one example, the six hollow cylindrical PVC pipe lengths are five feet. Also illustratively, the six hollow cylindrical PVC pipe segments are equal in length. In other embodiments, the top pole 112 and the auxiliary top pole 122 are equal in length with a first length. The two lower side poles 104 and 106 and two upper side poles 108 and 110, are equal in length with a second length. The first length may be different from the second length.

The two collars 114 and 116 and the two 90° elbow joints 118 and 120 are illustratively PVC pipe collars and PVC pipe elbow joints.

The PVC frame 102 advantageously is light in weight and highly durable and, therefore, highly suitable for a portable soccer technique training apparatus 100. The frame 102 may be alternatively constructed from a material other than PVC pipe. For example, the frame 102 may be constructed from other rigid plastic or metal such as aluminum or lightweight aluminum alloy.

Figure 2:
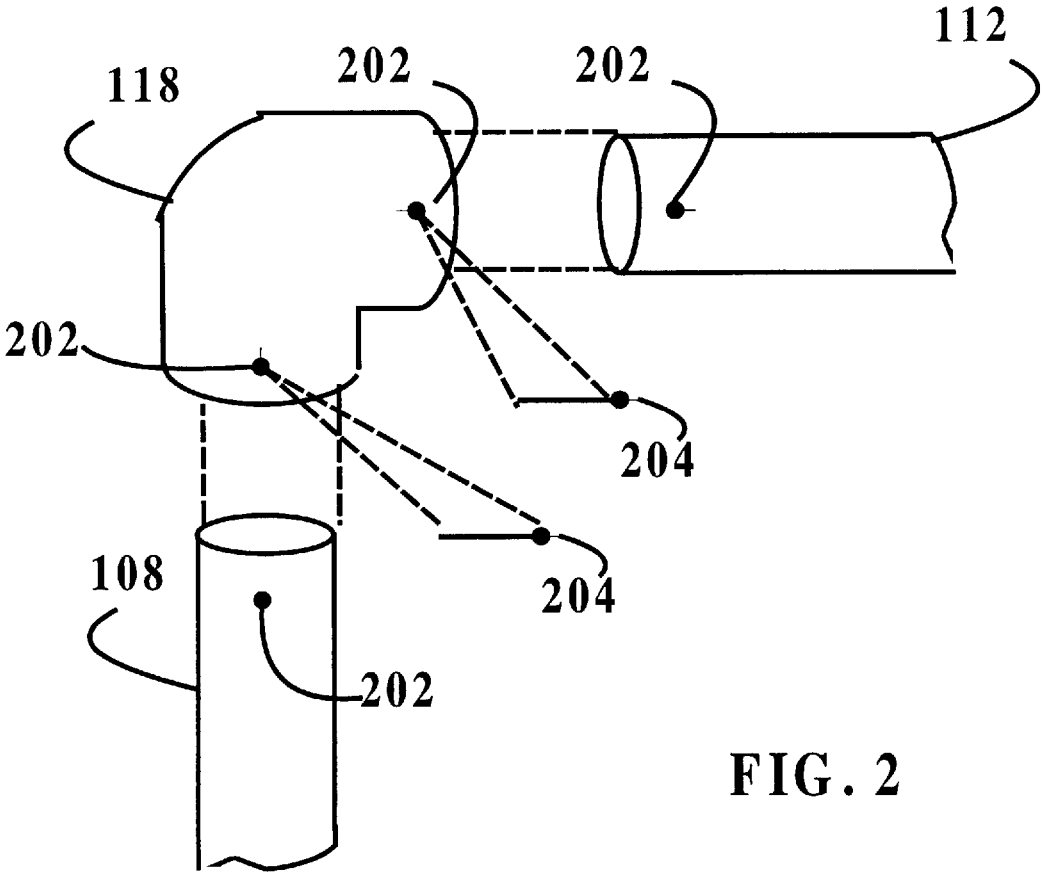
FIG. 2 is a schematic pictorial telescopic view illustrating a connection between the upper side pole, the 90° elbow joint, and the top pole of the portable soccer technique training apparatus.

Referring to FIG. 2, a schematic pictorial telescopic view illustrates a connection between the upper side pole 108, the 90° elbow joint 118, and the top pole 112. Apertures 202 are drilled through the top pole 112, the upper side pole 108, and the 90° elbow joint 118 in a substantially horizontal plane and substantially through the midpoint of a circular plane of the cylindrical top pole 112 and upper side pole 108. The top pole 112 and the upper side pole 108 are inserted into the 90° elbow joints 118 until the apertures 202 are aligned. A rivet 204 or pin is inserted into aligned apertures 202 to firmly bind the poles and joints. The rivet 204 may be replaced by any suitable device for affixing the poles and joints. Examples of suitable affixing devices include bolts, screws, clamps and the like. The top pole 112, the upper side pole 110 and the 90° elbow joint 120 are connected similarly.

Figure 3:
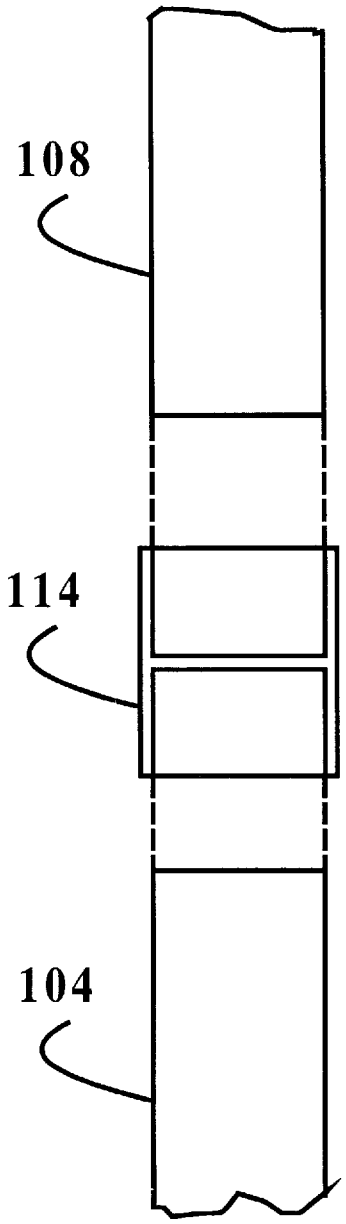
FIG. 3 is a schematic cross-sectional view of a connection of the lower side pole, the upper side pole, and the collar.

Referring to FIG. 3, a schematic cross-sectional view of a connection of the lower side pole 104, the upper side pole 108, and the collar 114. The collar 114 is generally cylindrical but is bisected by a solid midsection that holds the collar 114 in contact with the lower side pole 104 and the upper side pole 108. The lower side pole 106 is similarly connected to the upper side pole 110 by the collar 116.

Figure 4:
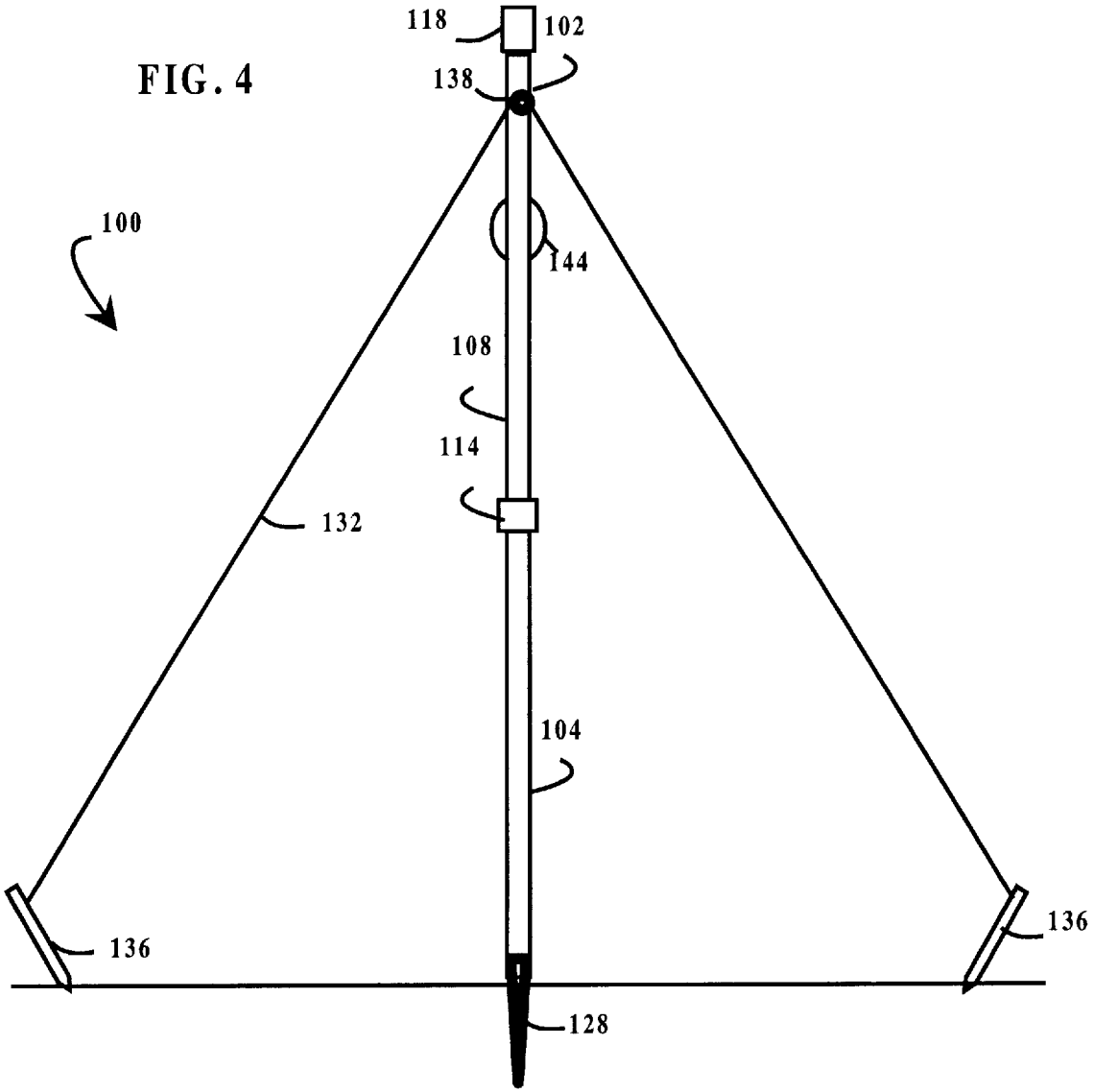
FIG. 4 is a schematic pictorial side view illustrating the portable soccer technique training apparatus shown in FIG. 1.

Referring to a schematic side pictorial view of the portable soccer technique training apparatus 100 in FIG. 4 in combination with FIG. 1, two metal anchor pins 128 and 130 are driven into the ground at a suitable position and the two lower side poles 104 and 106 are respectively placed over the two metal anchor pins 128 and 130. The two metal anchor pins 128 and 130 hold the frame 102 in position on a surface, typically a grass surface suitable for soccer playing, although other surfaces such as sand, gravel or dirt may be used. The two metal anchor pins 128 and 130 affix the position of the frame 102 rather than supporting the frame 102. The vertical positioning of the frame 102 is supported by two lines 132 and 134 affixed by four stakes 136, such as wooden tent stakes. A first line 132 is tautly tied between two stakes 136 and threaded through an eye hook 138 attached to the upper side pole 108. The second line 134 is tautly tied between two stakes 136 and threaded through an eye hook 140 attached to the upper side pole 110. The two lines 132 and 134 are formed from suitable structures such as ropes, cables, wires, chains, strong strings or twines that are sufficiently strong to support the frame 102.

The illustrative vertical support structure is highly advantageous compared to structures that utilize vertical positioning with a support structure firmly attached to the ground and having sufficient strength to support the frame 102 while in use. Such a ground-based vertical support structure is generally permanently installed into the ground or so heavy that portability is not achieved. In one example of a ground-based vertical support structure, a permanent pole is driven deeply into the ground or supported by a concrete base. In contrast, the illustrative vertical support structure is completely portable and capable of set-up in virtually any suitably horizontal surface, no matter how compact. The portable soccer technique training apparatus 100 is installed with virtually no impact on the environment such as formation of buried concrete support blocks that could injure players when the training apparatus is removed.

The illustrative vertical support structure is installed simply by driving the two metal anchor pins 128 and 130 into the ground, raising the frame 102 to a position in which the two lower side poles 104 and 106 and two upper side poles 108 and 110 are disposed vertically, driving the four stakes 136 into the ground, passing the lines 132 and 134 through the eye hooks 138 and 140, and tautly tying the lines 132 and 134 to the stakes 136. Advantageously, the two metal anchor pins 128 and 130 and the stakes 136 are very light in weight so that the vertical support structure is highly portable and positionable in virtually any location. Accordingly, the portable soccer technique training apparatus 100 is suitable for usage at home, even in small yard areas, as well as fields, clubs, parks, schools and beaches. The portable soccer technique training apparatus 100 may be used indoors, as well as outdoors, by replacing the two metal anchor pins 128 and 130 and stakes 136 with any suitable structure such as tie hooks or anchor bolts. Furthermore, the vertical support structure is stable without support by any persons such as players or a coach so that an individual play advantageously may practice soccer skills alone.

A soccer ball 144 with an attachment structure 146 is suspended from the frame 102 to allow players to practice soccer techniques. In various embodiments, the attachment structure 146 is a leather loop, a plastic loop, a hook, a ring, a net bag, an aperture connected by a pin or cable extending through the aperture (for a ball that is not inflatable but rather solid), and the like. The soccer ball 144 is connected to a suspension line 152 which is supported by a swivel 148 with a latch 150 via the attachment structure 146. The suspension line 152 extends through a top eye hook 154 affixed to the top pole 112, then through a side eye hook 156 affixed to the upper side pole 108. The suspension line 152 is tied to a tie hook 158 with various lengths of the suspension line 152 extended so that the soccer ball 144 is suspended at various heights depending on the kind of activity an individual wishes to perform including low heights for practicing kicks and high heights for practicing head strikes.

The portable soccer technique training apparatus 100 includes a storage bag 160 for holding the entire portable soccer technique training apparatus 100. The entire portable soccer technique training apparatus 100 is easily carried by even a single person. The storage bag 160 and entire portable soccer technique training apparatus 100 are sufficiently compact that the entire system are easily carried in a small vehicle.

Figure 5:
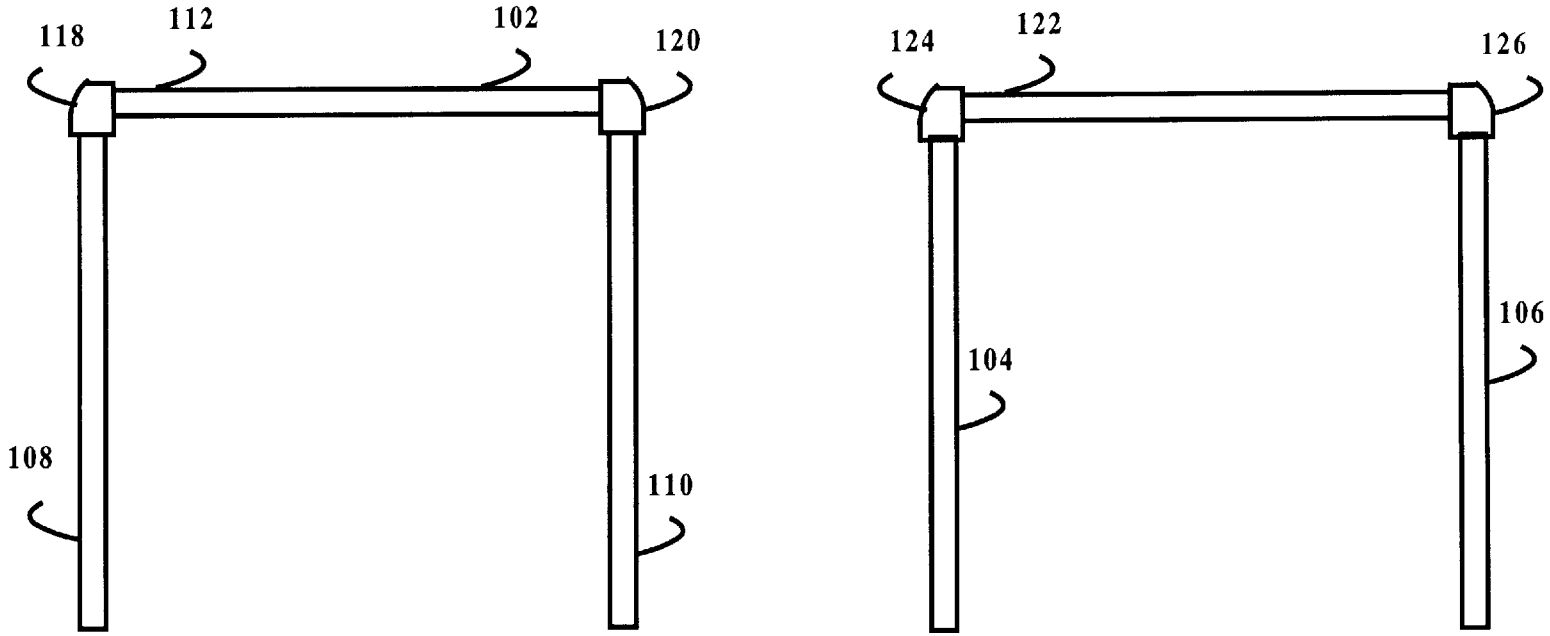
FIG. 5 is a schematic pictorial frontal view illustrating the portable soccer technique training apparatus assembled into two soccer goal structures.

The portable soccer technique training apparatus 100 may be partially dismantled to provide a soccer goal. In particular, the portion of the frame 102 including the top pole 112, the two 90° elbow joints 118 and 120, and the two upper side poles 108 and 110 are disconnected from the two collars 114 and 116 and the two lower side poles 104 and 106 and the soccer ball 144 removed to form a goal. In addition, referring to FIG. 5, a schematic pictorial view illustrates that the auxiliary top pole 122 and two auxiliary 90° elbow joints 124 and 126 are connected to the two lower side poles 104 and 106 to provide a second goal.

The portable soccer technique training apparatus 100 advantageously is a simple, safe, portable and affordable athletic device which is foremost intended for soccer training but is also highly suitable for other sports including volleyball. The portable soccer technique training apparatus 100 is sufficiently affordable that multiple assemblies may be used by teams to practice different skills in parallel including heading, striking, trapping and the like. Embodiments with slight variation in dimensions and shape may also be suitable for training in sports such as basketball, baseball, tennis, and others. For embodiments of the portable soccer technique training apparatus 100 intended for usage in soccer training, the portable soccer technique training apparatus 100 is useful in developing skills including timing, balance and coordination, striking skills with either the left foot or the right foot, and agility. The portable soccer technique training apparatus 100 is very useful in developing heading skills including maintaining cognizance of the position of the ball. The portable soccer technique training apparatus 100 is useful for practicing both static and dynamic skills.

While the invention has been described with reference to various embodiments, it will be understood that these embodiments are illustrative and that the scope of the invention is not limited to them. Many variations, modifications, additions and improvements of the embodiments described are possible. The invention is defined by the appended claims in light of their full scope of equivalents. For example, the illustrative embodiment utilizes specific connection structures such as a rivet or pin. Any suitable known connection device may be used to connect a pole to an elbow junction. Similarly, the apparatus is described as being constructed from PVC pipe. Any known lightweight tubular material may be used, constructed from any known suitably durable material. Furthermore, the portable soccer technique training apparatus is described as an apparatus for practicing soccer. In various embodiments, the illustrative apparatus is suitable for other athletic endeavors including baseball, softball, volleyball, basketball, football, tennis, badminton, and the like.

What is claimed is:

1. A soccer training apparatus comprising:

a support frame having a plurality of detachable firm frame segments including a first side segment, a second side segment, and a top segment, the support frame firm frame segments being detachable and mutually sized for conversion between a striking technique training structure and a soccer goal structure;

a first anchor pin affixing the position of the first side segment on a surface;

a second anchor pin affixing the position of the second side segment on the surface;

a first line for coupling to the first side segment and for stretching tautly between two anchors so that the first side segment is vertically supported;

a second line for coupling to the second side segment and for stretching tautly between two anchors so that the second side segment is vertically supported;

a suspension line for coupling, suspending and supporting a soccer ball from the top segment, the suspension line being adjustably connected to the top segment so that the soccer ball is suspended from the top segment an adjustable length to allow for a player to make various strikes of the soccer ball including kick strikes and head strikes.

2. An apparatus according to claim 1 wherein:

the first side segment is substantially equal in length to the second side segment.

3. An apparatus according to claim 1 further comprising:

a carrying case for carrying the firm frame segments after detachment.

4. An apparatus according to claim 1 further comprising:

a first elbow joint for detachably attaching the first side segment to the top segment; and a second elbow joint for detachably attaching the second side segment to the top segment.

5. An apparatus according to claim 1 wherein:

the first side segment is a detachable segment including a lower first side segment and an upper first side segment; and the second side segment is a detachable segment including a lower second side segment and an upper second side segment, the lower first side segment, the upper first side segment, the lower second side segment, and the upper second side segment being configurable as vertical side segments for two soccer goal structures.

6. An apparatus according to claim 1 wherein:

the first side segment further includes a first coupling collar for detachably coupling the lower first side segment and the upper first side segment; and the second side segment further includes a second coupling collar for detachably coupling the lower second side segment and the upper second side segment.

7. An apparatus according to claim 1 wherein:

the soccer ball is a regulation soccer ball coupled to the suspension line by an attachment structure.

8. An apparatus according to claim 7 wherein:

the attachment structure is a structure selected from a group including a leather loop, a plastic loop, a hook, a ring, a net bag, and a bolt extending through an aperture in the soccer ball.

9. An apparatus according to claim 1 wherein:

the first side segment is a detachable segment including a lower first side segment and an upper first side segment;

the second side segment is a detachable segment including a lower second side segment and an upper second side segment; and the apparatus further comprises:

an auxiliary top segment substantially similar to the top segment, two of the side segments selected from the lower first side segment, the upper first side segment, the lower second side segment, and the upper second side segment being coupled to the top segment and the remaining two side segments being coupled to the auxiliary top segment to form two soccer goal structures.

10. An apparatus according to claim 7 further comprising:

a first auxiliary elbow joint for detachably attaching a first of the two remaining side segments to the auxiliary top segment; and a second auxiliary elbow joint for detachably attaching a second of the remaining two side segments to the auxiliary top segment.

11. A soccer training apparatus comprising:

a support frame having a plurality of detachable firm frame segments including a first lower side segment, a first upper side segment, a second lower side segment, a second upper side segment, and a top segment, the support frame firm frame segments being detachable and sized for conversion between a striking technique training structure and a soccer goal structure;

an auxiliary top segment, two of the side segments selected from the lower first side segment, the upper first side segment, the lower second side segment, and the upper second side segment being coupled to the top segment and the remaining two side segments being coupled to the auxiliary top segment to form two goal structures;

a vertical support structure for supporting the support frame;

a suspension line for coupling, suspending and supporting a soccer ball from the top segment, the suspension line being adjustable connected to the top segment so that the soccer ball is suspended from the top segment an adjustable length to allow for a player to make various strikes of the soccer ball including kick strikes and head strikes.

12. An apparatus according to claim 11 wherein the vertical support structure further includes:

a first anchor pin affixing the position of the first side segment on a surface;

a second anchor pin affixing the position of the second side segment on the surface;

a first line for coupling to the first side segment and for stretching tautly between two anchors so that the first side segment is vertically supported;

a second line for coupling to the second side segment and for stretching tautly between two anchors so that the first side segment is vertically supported.

13. An apparatus according to claim 11 wherein:

the soccer ball is a regulation soccer ball coupled to the suspension line by an attachment structure.

14. An apparatus according to claim 13 wherein:

the attachment structure is a structure selected from a group including a leather loop, a plastic loop, a hook, a ring, a net bag, and a bolt extending through an aperture in the soccer ball.

* * * * *